US005471704A

United States Patent [19]

Woolley

[11] Patent Number: 5,471,704

[45] Date of Patent: Dec. 5, 1995

[54] CAULKING TOOL

[76] Inventor: Edward G. Woolley, 11 Greenock Cir., St. Catharines Ontario, Canada, L2S 1B3

[21] Appl. No.: 417,115

[22] Filed: Apr. 5, 1995

Related U.S. Application Data

[63] Continuation-in-part of Ser. No. 82,475, Jun. 28, 1993, abandoned.

[30] Foreign Application Priority Data

Apr. 28, 1993 [CA] Canada ..... 20972335

[51] Int. Cl.[6] ..... B05C 17/10; E04G 21/20

[52] U.S. Cl. ..... 15/235.7; 15/105.5; 15/235.3; 15/245.1; 425/458

[58] Field of Search ..... 15/105, 105.5, 15/235.7, 245.1, 235.3; 425/458

[56] References Cited

U.S. PATENT DOCUMENTS

| | | | |
|---|---|---|---|
| 3,761,992 | 10/1973 | Schneller | 15/210.1 |
| 3,846,060 | 11/1974 | Otis | 425/458 |
| 4,558,481 | 12/1985 | Jones | 15/105.5 |
| 4,586,890 | 5/1986 | Marchbanks | 15/105.5 |
| 4,698,870 | 10/1987 | Clark | 425/458 |
| 5,075,916 | 12/1991 | Englehart | 15/245.1 |
| 5,239,725 | 8/1993 | White | 15/245.1 |
| 5,240,394 | 8/1993 | James | 15/235.7 |

*Primary Examiner*—David Scherbel
*Assistant Examiner*—Randall E. Chin
*Attorney, Agent, or Firm*—Kvas Miller Everitt

[57] ABSTRACT

A tool for shaping caulking material having a shaping surface, a diverter surface adapted to divert caulking material to the shaping surface, a cavity disposed between the shaping surface and the diverter surface for receiving caulking material, and a plurality of interchangeable members releasably attachable to the tool so as to impart a plurality of shapes to the caulking material.

15 Claims, 5 Drawing Sheets

CAULKING TOOL

This application is a continuation-in-part application of application Ser. No. 08/082,476 filed Jun. 28, 1993, now abandoned.

FIELD OF INVENTION

This invention relates to caulking tool for shaping caulking material, and in particular relates to a tool for shaping a line of formable caulking material in a comer.

BACKGROUND OF THE INVENTION

Homes and buildings across the nation utilize caulking or sealing material in a variety of locations, and are particularly used in bathrooms around tubs and sinks to prevent water leaks onto wood flooring, supports, or the like. Caulking material is also used in many buildings around windows and doors to prevent air leaks.

From time to time one must remove and replace such caulking materials as it begins to deteriorate. This is usually a time consuming and messy job which often has unsatisfactory results for the non-professional. In particular, the caulking material is applied by means of a caulking gun which is well-known to those persons skilled in the art and applied in a line between two intersecting walls that usually define a corner at ninety degrees. The application of the line of caulking material particularly when applied by a non-professional has many bumps, or voids, where the caulking material has been applied too heavily, or not enough, respectively, so as to present a very unprofessional and unaesthetic look.

Various caulking tools have heretofore been designed in order to improve the appearance, as well as the application of, a line of caulking material applied in a corner.

For example, U.S. Pat. No. 3,761,992 relates to a corner caulking tool comprising a head and structure for holding the head where the head consists of a substantially square sheet rubber gasket having a working edge remote from the holding structure.

Moreover, U.S. Pat. No. 3,846,060 relates to a trolling tool for use in smoothing and shaping mastic caulking compounds, which comprises a body member having aligned and bearing surface at its sides to rest upon and be guided by right angularly disposed wall surface contiguous with a corner joint or juncture being caulked.

Yet another arrangement is disclosed in U.S. Pat. No. 4,586,890 which relates to a cock bead tool used to uniformly compress and contour a bead of caulk, grout, putty or other fluent material.

Yet another arrangement is shown in U.S. Pat. No. 3,821,828 which describes a tool for applying putty either to a window in which putty must be formed on all sides of the window frame, or to a window in which putty is excluded from one or more sides of the window frame.

Finally, U.S. Pat. No. 1,264,610 discloses a caulking iron while U.S. Pat. No. 1,851,497 teaches a brick mason's pointing tool.

These and other prior art devices present tools which have limited utility.

It is an object of this invention to provide an improved caulking tool for smoothing and improving the appearance and efficiency of a line of fluent or formable caulking material.

The broadest aspect of this invention relates to a tool for shaping caulking material comprising: a shaping surface at one end of said tool, a diverter surface at another end of said tool adapted to divert caulking material to said shaping surface, and a cavity disposed between said shaping surface and said diverter surface for receiving caulking material.

Another aspect of this invention relates to a tool for shaping a line of formable caulking material in a comer comprising: a top portion having a first end and another end, a pair of spaced side walls diverging from said top portion between said ends, a groove presented by said top portion between said side walls and extending between said ends, shaping insert slidably receivable by said groove, said insert presenting a shaping surface adjacent said first end for shaping said line of caulking material, a diverter surface disposed between said side walls and spaced from said shaping surface for diverting excess caulking material between said side walls towards said shaping surface.

Yet another aspect of this invention relates to a method of shaping a line of formable caulking material in a corner with a tool having a shaping surface at one end of the tool, a diverter surface at the other end thereof, and a receiving cavity disposed between said shaping surface and said diverter surface, comprising the steps of: placing said tool over said line of formable caulking material with said shaping surface contacting said line of caulking material, moving said tool along said line whereby: said shaping surface imparts a shape to said line of caulking material, excess caulking material is trapped within said cavity and diverted toward said shaping edge and said diverter surface, said diverter surface diverting excess caulking material back toward said shaping surface.

DRAWINGS

These and other objects and features of the invention shall now be described in relation to the drawings.

DESCRIPTION OF THE INVENTION

Like parts shall be given like numbers throughout the figures.

Figure 1:
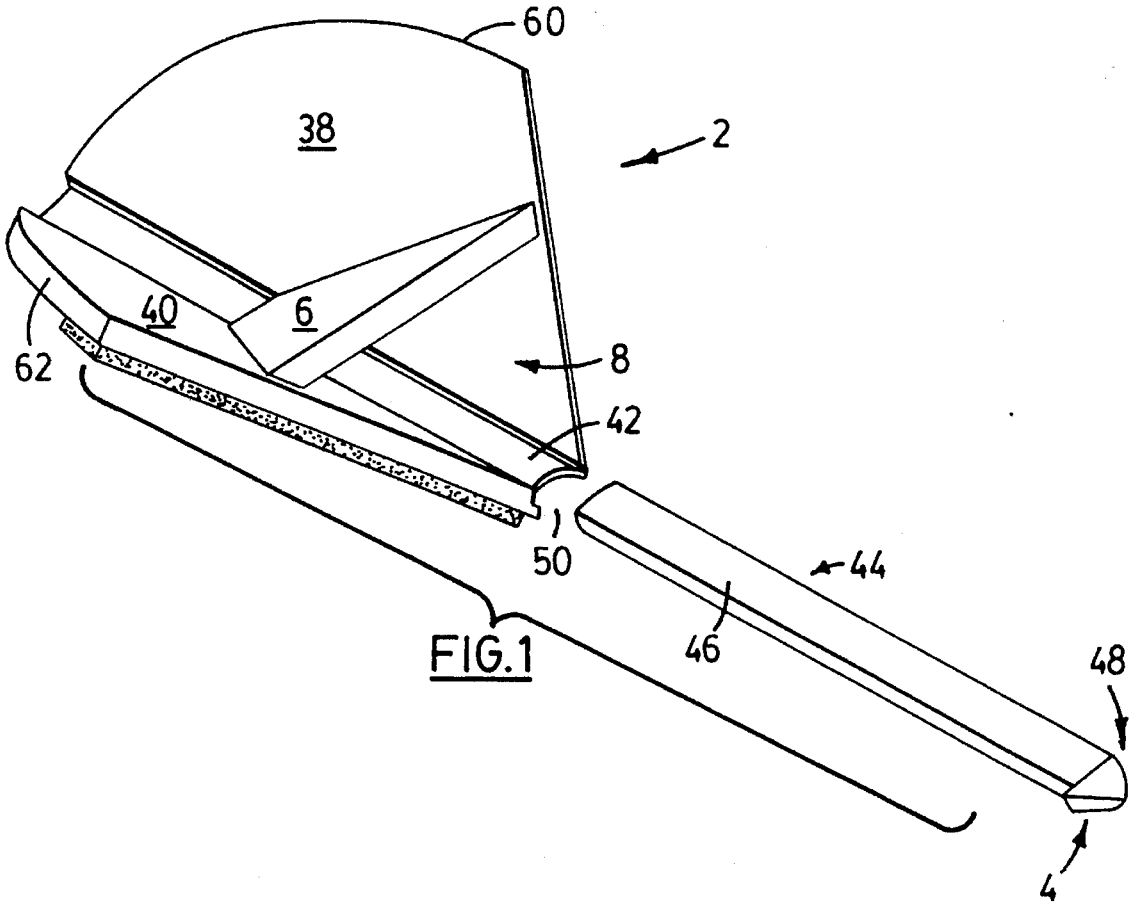
FIG. 1 is a perspective exploded view of the tool.

FIG. 1 illustrates the caulking tool or shaping tool 2 which generally comprises a shaping means or shaping surface 4, a diverter surface 6 and receiving cavity 8.

The caulking tool 2 is generally adapted to shape a line 10 of caulking material 12 which is in a corner 14 as best illustrated in FIGS. 3 and 10, 12, 14, 16 and 18. The corner 14 is defined by two intersecting walls 16 and 18. The walls 16 and 18 may be disposed at any angle less than 180°, but generally speaking will consist of a corner having a 90° angle.

The caulking tool to be described herein is utilized to shape a line 10 of caulking material 12. In particular, by reference to FIG. 3, amateurs, as well as professionals, when applying a line 10 of caulking material 12 present a line which is irregular in shape and includes many bumps 20 and voids 22 so as to present a line which is unaesthetic in appearance. Moreover, such irregular line 10 particularly when presenting voids 22 presents a caulking line 10 which is less efficient in heat retaining or sealing quality than desired.

By utilizing the caulking tool to be described herein, a line 10 of caulking material 12 is presented which has a smooth appearance or contour 24.

Figure 6:
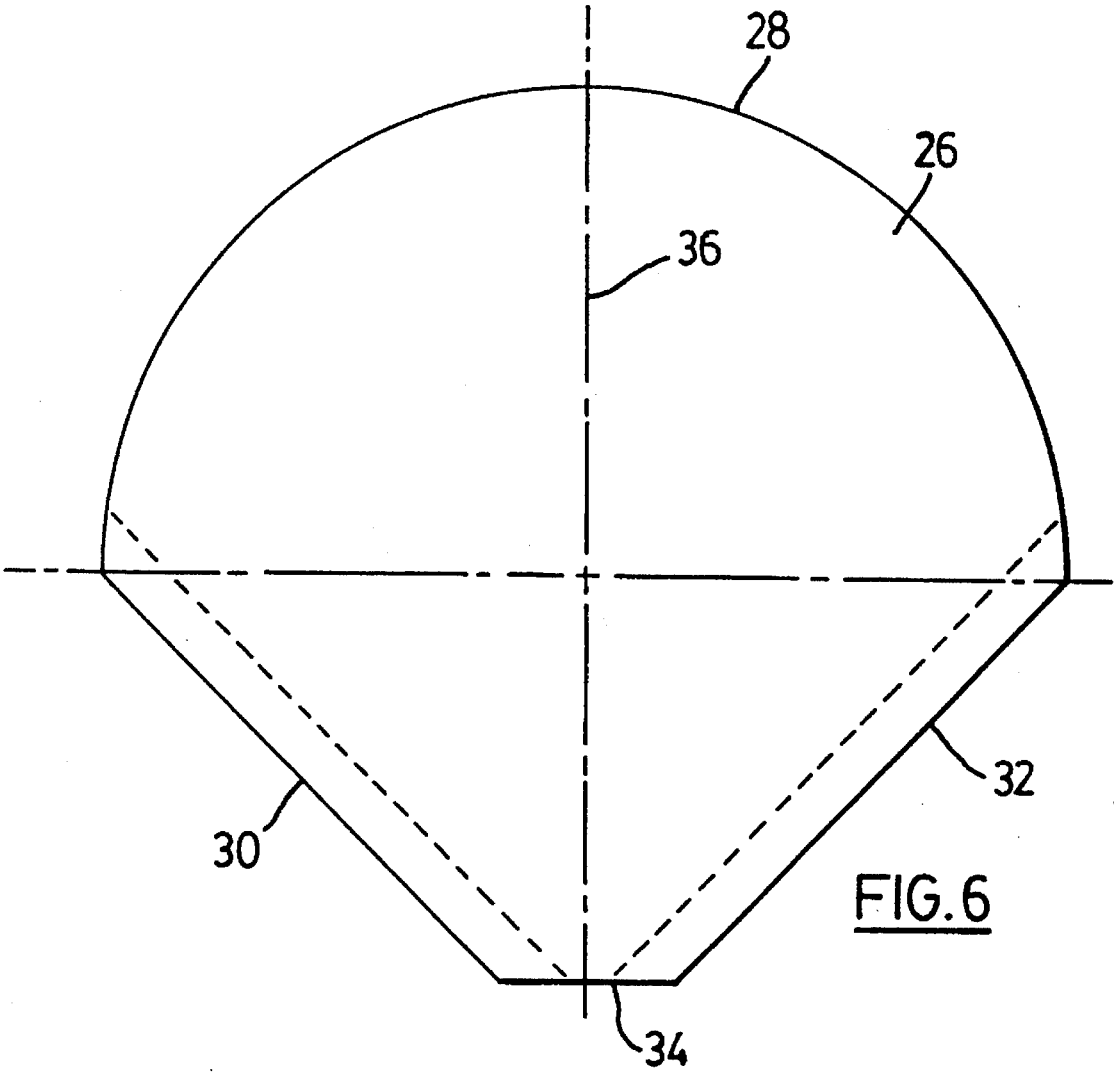
FIG. 6 is a top plan view of the tool prior to bending.
Figure 7:
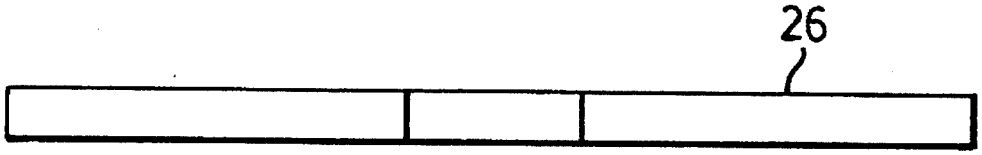
FIG. 7 is an end view of the tool prior to bending.
Figure 5:
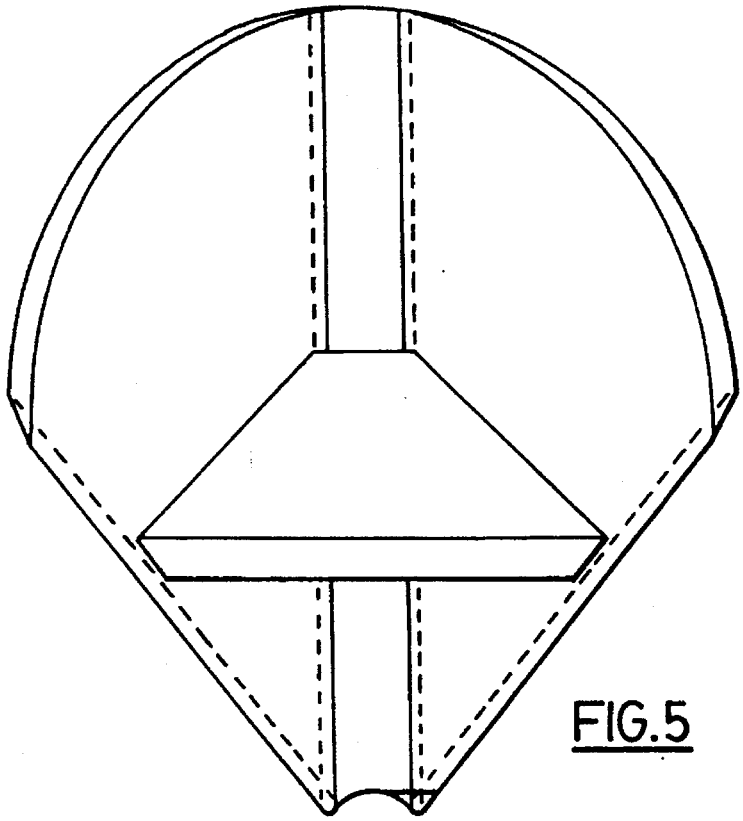
FIG. 5 is a bottom view of the tool.

In particular, the caulking tool 2 is comprised of a flat surface 26 as shown in FIGS. 6 and 7 which in the preferred embodiment presents a curved back edge 28 and a pair of parametral cleaning edges 30 and 32 which cleaning edges 30 and 32 converge in the direction from the back edge 28 to a front edge 34. The flat surface 26 can be comprised of a variety of materials, including plastic or the like.

Figure 2:
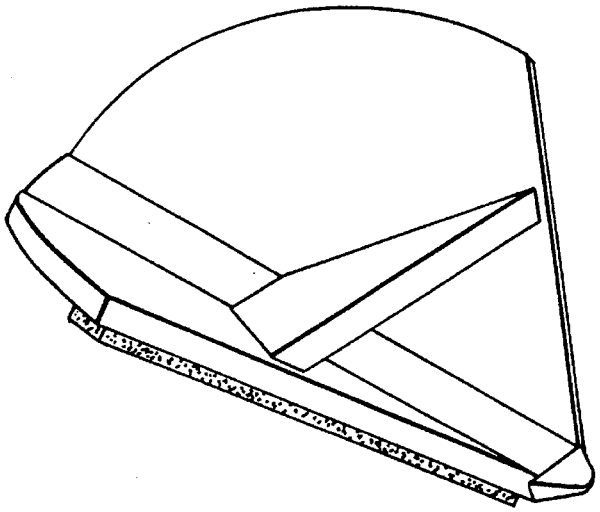
FIG. 2 is a perspective view of the tool with the insert 44 inserted into the groove 42.
Figure 3:
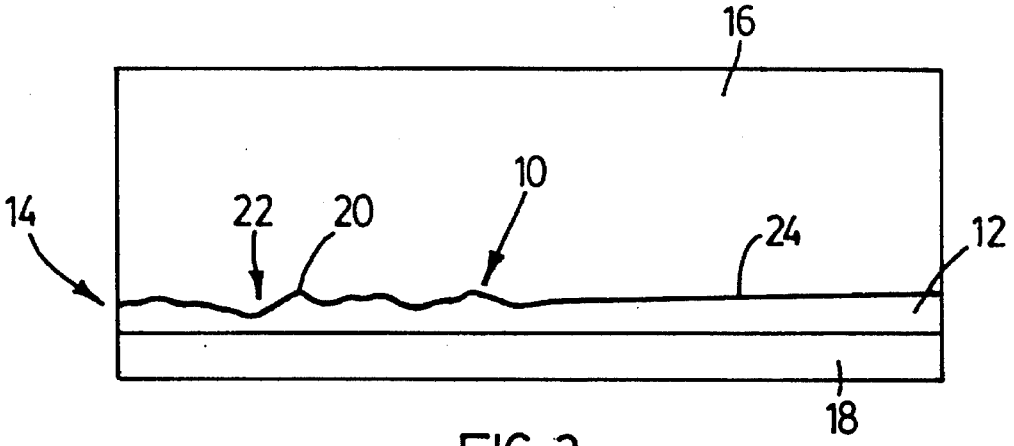
FIG. 3 is a side view of a corner with a line of caulking.
Figure 4:
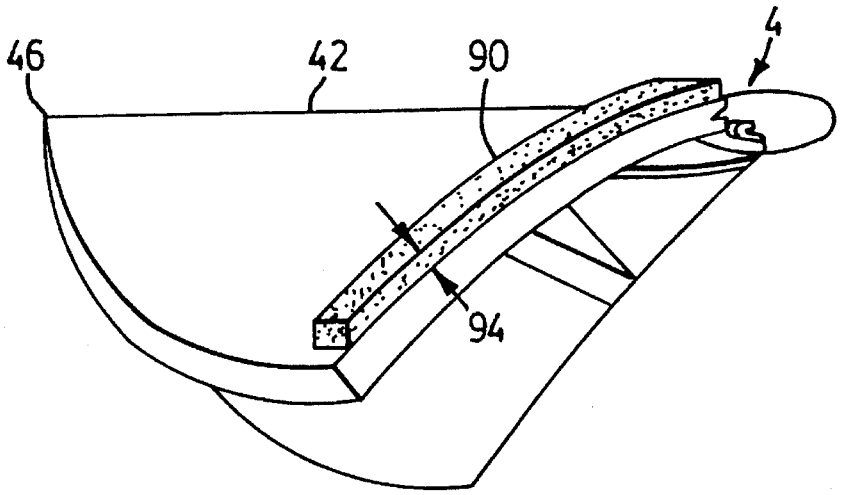
FIG. 4 is a side elevational view of the tool.
Figure 8:
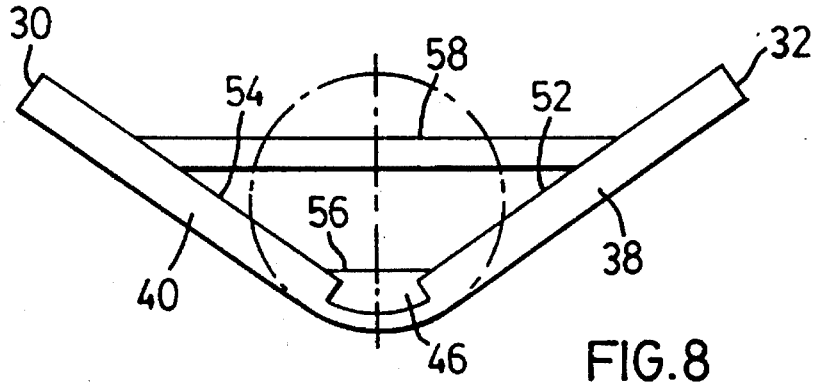
FIG. 8 is an end view of the tool after bending.

The flat surface 26 may be bent as shown in FIGS. 1 and 2 along the centre line 36 so as to present a tool 2 having a pair of side walls 38 and 40. In particular, the tool 2 includes a top portion 42 which has a first end 44 and another end 46 as best seen in FIG. 4. The pair of spaced side walls 38 and 40 diverge from the top portion 42 between the ends 44 and 46 as best seen in FIG. 8. A groove or receiving means 42 is presented by the top portion 42 between the side walls 38 and 40 and extends between the ends 44 and 46. The groove 42 is adapted to receive a plurality of interchangeable members or shaping inserts 44 in a manner to be described herein. The caulking tool is adapted to receive a plurality of interchangeable inserts 44 one at a time so as to permit easy selection of the desired profile of the line or bead of caulking material.

The interchangeable inserts 44 generally present an elongated member or shaft 46 extending longitudinally along the length thereof from one end 48 to another end 50. The cross section of the shaping insert 44 is shaped so as to be received by the cross-section of the groove 42 as best illustrated in FIG. 8. Accordingly, a variety of interchangeable inserts 44 may be slidingly displaceably moved within the groove 42 as well as pulled out therefrom.

The caulking tool 2 also includes a diverter surface 6 which spans between the side walls 38 and 40 as best illustrated in FIG. 2. The diverter surface 6 may be comprised of a variety of materials including plastic and is secured to the side walls 38 and 40 by a variety of means including gluing or fastening same by other means including screws or bolts. The diverter surface 6 presents diverter side walls 52 and 54 which are defined by the side walls 38 and 40, respectively. The diverter surface 6 also includes a short wall 56 which ends just before the groove 42 so as to permit insertion of the insert 44 between the groove and diverter wall 6.

Moreover, the diverter wall 6 includes a longer wall 58 which is disposed below the parametral side edges 60 and 62 of side walls 38 and 40.

Figure 9:
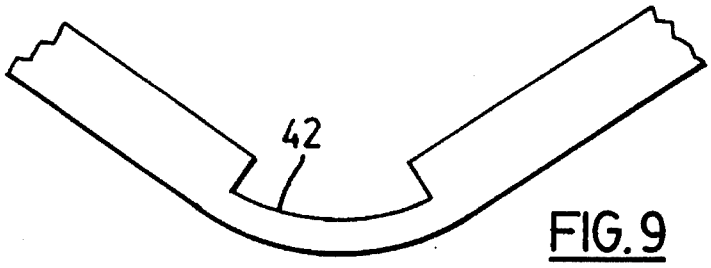
FIG. 9 is an expanded view of the groove.

The groove 42 may be produced in a variety of methods including the milling out or cutting out of the groove 42 prior to the folding of the flat surface 26 and thereafter folding said flat surface 26 so as to present the groove as best seen in FIG. 9; or by extruding the groove 42.

The side walls 38 and 40 present parametral cleaning edges 30 and 32 which are adapted to contact the walls 16 and 18 when the caulking tool is pulled along the line of caulking material 10. In particular, the parametral cleaning edges 30 and 32 converge towards the first end 44.

Figure 10:
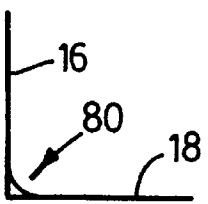
FIG. 10 is a side view of a comer with a rounded bead.
Figure 11:
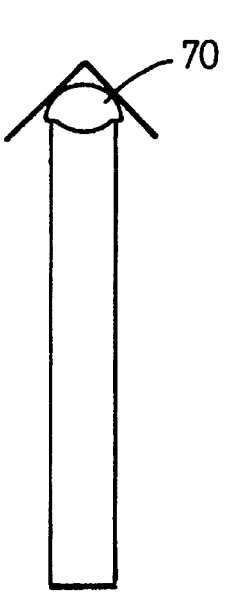
FIG. 11 is a top plan view of the insert to produce the contour of FIG. 10.

The inserts 44 present a variety of shaping surfaces 70, 72, 74, 76 and 78, so as to impart a variety of selectable shapes or profiles 80 as best illustrated in FIGS. 10, 12, 14, 16 and 18. In particular, FIG. 10 illustrates an insert tool 44 having a shaping surface 4 with a convex surface so as to impart a concave surface to the line 10 of caulking material.

Figure 12:
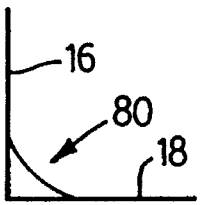
FIG. 12 is a side view of a corner with a different profile of bead.
Figure 13:
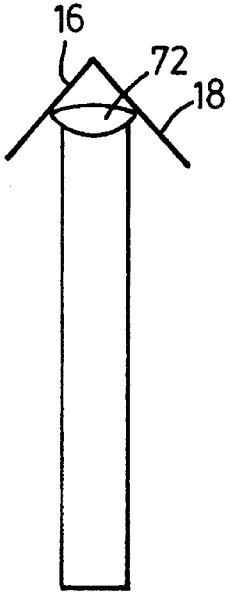
FIG. 13 is a top view of an insert to produce the profile of FIG. 12.
Figure 14:
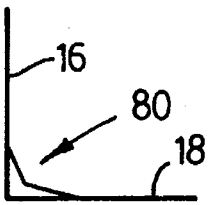
FIG. 14 is another side view of a corner with a shaped bead of material.
Figure 15:
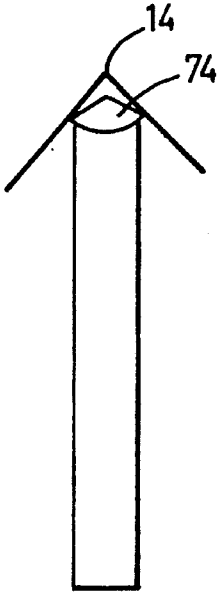
FIG. 15 is a top plan view of an insert to produce the shape of bead shown in FIG. 14.
Figure 17:
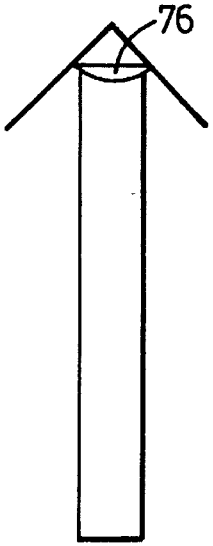
FIG. 17 is a top plan view of an insert to produce the bead shown in FIG. 16.
Figure 18:
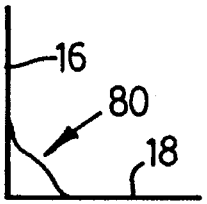
FIG. 18 is a further side view of a corner with another profile of bead.
Figure 19:
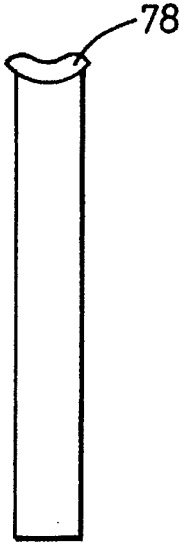
FIG. 19 is a top plan view of an insert to produce the profile of FIG. 18.

FIGS. 12 and 13 illustrate an insert 44 having a shaping surface 72 which presents a much larger convex diameter so as present a concave surface in the line of caulking material 10 as shown in FIG. 12. Furthermore, FIG. 15 illustrates an insert 44 having a shaping surface 72 presenting two converging lines, while FIG. 17 discloses an insert 44 having a straight shaping edge 76. Other shapes can be utilized as illustrated in FIG. 19 which comprises a combination of convex and concave surfaces.

Accordingly, once insert 44 is inserted into the groove 42 the shaping surface 4 is presented at one end 44 of the tool.

Although the invention described herein illustrates the use of a plurality of interchangeable and insertable inserts 44, the invention also encompasses the utilization of a single piece whereby the shaping surface 4 is integral with the rest of the tool 2. In such embodiment, a variety of tools having different shaping surfaces 48 could be utilized.

In operation, the tool 2 is held in the fingers of the user so that the top 42 will be facing the viewer, while the diverter surface 6 will be slightly above the line of caulking material 10. In particular, the tool 2 will be placed adjacent the walls 16 and 18 such that the shaping edges 30 and 32 contact the walls 16 and 18 while the shaping surface 4 contacts the line of formable caulking material 10. Thereafter, the tool 2 will be pulled along the line 10 of caulking material 12 so that the shaping surface 48 shapes the line of caulking material 10 by moving excess caulking material 20 presented by bumps. While the caulking tool 2 is moved along the line 10, excess caulking material will be moved or displaced by the shaping tool 48 into the voids 22 so as to present a smooth line 24. Further excess material will be diverted by the shaping edge 4 into the cavity 8 which is defined by the side walls 38 and 40 as well as diverter surface 6. As the excess caulking material accumulates within the cavity 8, the caulking material will be pushed towards the diverter surface 6.

The diverter surface 6 is disposed at an acute angle relative the groove 42 so as to redirect excess caulking material back towards the shaping surface 48.

Figure 16:
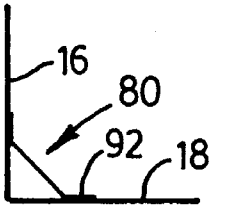
FIG. 16 is a side view of a corner with another profile of bead.

Moreover, the side walls 38 and 40 present on the back surface thereof, a strip of rubber 90. The strip of rubber 90 is adapted to ride along the walls 16 and 18 and smooth out any caulking material so as to present a slight film 92 which is best illustrated in FIG. 16. In other words, the width of the film 92 corresponds to the thickness 94 of the rubber strips 90. The film 92 enhances the sealing capabilities of the caulking material 12.

The method of shaping a line of formable caulking material 10 in a corner 14 with the tool 2 shall now be described. The user will select the appropriate insert 44 having the desired shaping surface 4. Thereafter the tool 2 will be inserted over the line 10 of formable caulking material 12 with the shaping surface 4 contacting the line 10 of the caulking material 12. Thereafter, the tool 2 is moved or pulled along the line 10 whereby the shaping surface 48 imparts a shape to the line 10 of caulking material 12. Any excess caulking material 12 is trapped within the cavity 8 and diverted towards the shaping edge 4 as well as the diverted surface 6. Furthermore, the diverter surface 6 diverts excess caulking material 12 back towards the shaping surface 4.

Figure 20:
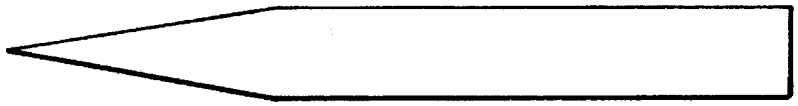
FIG. 20 is a top plan view of a tool for removing old caulking.

FIG. 20 also shows an insert or tool having a sharp point which may be inserted into the groove 42 so as to remove old cured caulking material. Thereafter the tool 2 can be utilized in the manner described above to shape fresh or formable caulking material prior to curing.

It should be noted that the caulking tool 2 is comprised of plastic or transparent material which may be easily washed and re-used a number of times. Alternatively, disposable caulking tools 2 may be utilized which do not have insertable inserts 44 but rather present a one piece caulking tool 2 which has the appropriate shaping edge 4 applied thereto. After use the tool could be washed and used again or disposed of.

The tool is placed at one end of the line 10 of caulking 12 and pulled along the entire line or strip continuing along other sides if there is more than one comer such as the sides of a window. The purpose of the tool 2 is to shape the line 10 of caulking 12 while removing any excess caulking leaving a tightly shaped caulking strip. Different inserts 44 would fit into the tool 2 which mould a different shape. The tool 2 has foam or robber sides 90. The shaping edge 4 is designed with sharp moulded plastic edges. The sharp tool shown in FIG. 20 is used to remove old caulking and can also be used to clean tool 2. A separate tool can be utilized as well to remove old caulking.

The tool 2 is used for shaping caulking material 12 after it has been applied, but before it is cured. The tool 2 gives a professional appearance to the finished product without the traditional mess. The various inserts 44 can be washed or can be utilized in one application and then discarded.

Although the preferred embodiment as well as the operation and the use have been specifically described in relation to the drawings, it should be understood the variations in the preferred embodiment could be achieved by a man skilled in the art without departing from the spirit of the invention. Accordingly, the invention should not be understood to be limited to the exact form revealed by the drawings.

I claim:

1. A tool for shaping caulking material comprising:

(a) a shaping surface;

(b) a diverter surface adapted to divert caulking material to said shaping surface;

(c) a cavity disposed between said shaping surface and said diverter surface for receiving caulking material; and, (d) a plurality of interchangeable members releasably attachable to said tool so as to impart a plurality of shapes to said caulking material.

2. A tool as claimed in claim 1, further including a folded surface forming two side walls, and wherein said cavity is defined by said side walls, said diverter surface and said shaping surface.

3. A tool as claimed in claim 2, wherein said side walls each have one straight edge.

4. A tool as claimed in claim 3, wherein each of said straight edges of said side walls converge toward said shaping surface.

5. A tool as claimed in claim 4, wherein one of said plurality of interchangeable members has a convex end to impart a concave shape to said caulking material.

6. A tool as claimed in claim 2 wherein said folded surface includes an elongate groove, said groove positioned between said side walls and adapted to receive said interchangeable members.

7. A tool as claimed in claim 2 wherein said diverter surface is disposed at an acute angle relative said groove.

8. A tool as claimed in claim 7 comprising transparent material in order that a user may view caulking material inside said cavity.

9. A tool as claimed in claim 4, wherein one of said plurality of interchangeable members has a concave end to impart a convex shape to said caulking material.

10. A tool as claimed in claim 4 wherein one of said plurality of interchangeable members has a flat end to impart a flat shape to said caulking material.

11. A tool as claimed in claim 4 wherein one of said plurality of interchangeable members has an end to scrape said caulking material.

12. A tool for shaping a line of formable caulking material in a corner comprising:

(a) a top portion having a first end and a second end;

(b) a pair of spaced side walls diverging from said top portion between said ends;

(c) a groove formed in said top portion between said side walls and extending between said ends;

(d) a shaping insert slidably receivable by said groove, said insert providing a shaping surface adjacent said first end for shaping said line of caulking material; and (e) a diverter surface disposed between said side walls and spaced from said shaping surface for diverting excess caulking material between said side walls towards said shaping surface.

13. A tool as claimed in claim 12 wherein said diverter surface is disposed at an acute angle relative to said groove from said first end.

14. A tool as claimed in claim 13 wherein each of said side walls forms a parametral cleaning edge converging towards said shaping surface.

15. A tool as claimed in claim 14 wherein said side walls each include a rubber strip adjacent said parametral edge to smooth said caulking.

* * * * *